US007042309B2

(12) United States Patent
Podell

(10) Patent No.: US 7,042,309 B2
(45) Date of Patent: May 9, 2006

(54) PHASE INVERTER AND COUPLER ASSEMBLY

(75) Inventor: Allen F. Podell, Palo Alto, CA (US)

(73) Assignee: Werlatone, Inc., Brewster, NY (US)

( * ) Notice: Subject to any disclaimer, the term of this patent is extended or adjusted under 35 U.S.C. 154(b) by 31 days.

(21) Appl. No.: 10/861,541

(22) Filed: Jun. 4, 2004

(65) Prior Publication Data

US 2005/0122186 A1 Jun. 9, 2005

Related U.S. Application Data

(63) Continuation-in-part of application No. 10/731,174, filed on Dec. 8, 2003.

(51) Int. Cl.
*H01P 5/18* (2006.01)
*H01P 1/18* (2006.01)

(52) U.S. Cl. ..... 333/112; 333/117; 333/156

(58) Field of Classification Search ..... 333/24.1, 333/112, 116, 117, 109, 139, 156
See application file for complete search history.

(56) References Cited

U.S. PATENT DOCUMENTS

| | | | | |
|---|---|---|---|---|
| 3,184,691 | A | 5/1965 | Marcatili et al. | 333/110 |
| 3,345,585 | A | 10/1967 | Hildebrand | 333/116 |
| 3,514,722 | A | 5/1970 | Cappucci | 333/112 |
| 3,516,024 | A | 6/1970 | Lange | 333/116 |
| 3,748,601 | A | 7/1973 | Seidel | 333/109 |
| 3,869,585 | A * | 3/1975 | Snyder | 333/118 |
| 3,904,991 | A | 9/1975 | Ishii et al. | 333/116 |
| 3,967,220 | A | 6/1976 | Tagashira et al. | 333/28 R |
| 3,999,150 | A | 12/1976 | Caragliano et al. | 333/116 |
| 4,153,886 | A * | 5/1979 | Miedema | 333/156 |
| 4,153,994 | A * | 5/1979 | Ren | 333/157 |
| 4,158,184 | A | 6/1979 | Kenyon | 333/208 |
| 4,216,446 | A | 8/1980 | Iwer | 333/112 |
| 4,482,873 | A | 11/1984 | Nyhus | 333/116 |
| 4,777,458 | A | 10/1988 | Pardini | 333/112 |
| 4,800,345 | A | 1/1989 | Podell et al. | 333/111 |
| 4,841,262 | A * | 6/1989 | Lomangino | 333/81 R |
| 4,937,541 | A | 6/1990 | Podell et al. | 333/116 |
| 4,999,593 | A | 3/1991 | Anderson | 333/112 |
| 5,369,379 | A | 11/1994 | Fujiki | 333/116 |
| 5,557,245 | A | 9/1996 | Taketa et al. | 333/116 |
| 5,563,558 | A | 10/1996 | Mohwinkel et al. | 333/127 |
| 5,634,208 | A | 5/1997 | Nishikawa et al. | 455/327 |
| 5,689,217 | A | 11/1997 | Gu et al. | 333/116 |
| 5,742,210 | A | 4/1998 | Chaturvedi et al. | 333/116 |

(Continued)

OTHER PUBLICATIONS

An, Hongming et. al, *IA 50: 1 Bandwidth Cost-Effective Coupler with Sliced Coaxial Cable*, IEEE MTT-S Digest, pp. 789-792, Jun. 1996.

(Continued)

*Primary Examiner*—Dean Takaoka
(74) *Attorney, Agent, or Firm*—Kolisch Hartwell, PC

(57) ABSTRACT

A circuit assembly may include one or more coupler sections, and may include a phase inverter and/or a phase shifter. A coupler section may include a phase inverter. A coupler may include first and second mutually coupled spirals disposed on opposite sides of a dielectric substrate. Conductors forming the spirals may be opposite each other on the substrate and each spiral may include one or more portions on each side of the substrate. Some circuit assemblies may include first and second multi-port coupler sections. A phase inverter or a phase shifter may be coupled between coupler sections. In some examples, a circuit assembly may include first and second conductors each having first and second ends and mutually inductively coupled turns, and a capacitive device coupling the first ends of the first and second conductors to a reference potential.

18 Claims, 9 Drawing Sheets

U.S. PATENT DOCUMENTS

| | | | | |
|---|---|---|---|---|
| 5,781,071 | A | 7/1998 | Kusunoki | 330/269 |
| 5,793,272 | A | 8/1998 | Burghartz et al. | 336/200 |
| 5,841,328 | A | 11/1998 | Hayashi | 333/116 |
| 5,852,866 | A | 12/1998 | Kuettner et al. | 29/608 |
| 5,889,444 | A | 3/1999 | Johnson et al. | 333/127 |
| 5,926,076 | A | 7/1999 | Johnson et al. | 333/109 |
| 5,982,252 | A | 11/1999 | Werlau | 333/127 |
| 6,020,783 | A | 2/2000 | Coppola | 327/556 |
| 6,246,299 | B1 | 6/2001 | Werlau | 333/127 |
| 6,342,681 | B1 | 1/2002 | Goldberger et al. | 174/261 |
| 6,346,863 | B1 | 2/2002 | Sasaki et al. | 333/116 |
| 6,396,362 | B1 | 5/2002 | Mourant et al. | 333/25 |
| 6,407,647 | B1 | 6/2002 | Apel et al. | 333/25 |
| 6,407,648 | B1 | 6/2002 | Johnson | 333/127 |
| 6,483,397 | B1 | 11/2002 | Catoiu | 333/116 |
| 6,515,556 | B1 | 2/2003 | Kato et al. | 333/116 |
| 6,518,856 | B1 | 2/2003 | Casale et al. | 333/124 |
| 6,522,222 | B1 | 2/2003 | Pchelnikov et al. | 333/161 |
| 6,580,334 | B1 | 6/2003 | Simburger et al. | 333/24 R |
| 6,642,809 | B1 | 11/2003 | Shin et al. | 333/116 |
| 6,686,812 | B1 | 2/2004 | Gilbert et al. | 333/112 |
| 6,747,525 | B1 | 6/2004 | Iida et al. | 333/116 |
| 6,756,860 | B1 | 6/2004 | Shin | 333/116 |
| 6,765,455 | B1 | 7/2004 | De Lillo et al. | 333/116 |
| 6,771,141 | B1 | 8/2004 | Iida | 333/116 |
| 6,806,558 | B1 | 10/2004 | Apel | 257/663 |
| 6,806,789 | B1 * | 10/2004 | Bawell et al. | 333/117 |
| 6,819,200 | B1 | 11/2004 | Zhao et al. | 333/25 |

OTHER PUBLICATIONS

Walker, J.L.B., *Analysis and Design of Kemp-Type 3 dB Quadrature Couplers*, IEEE Transactions on Microwave Theory and Techniques, vol. 38, No. 1, pp. 88-90, Jan. 1990.

Bickford, Joel D. et. al, *Ultra-Broadband High-Directivity Directional Coupler Design*, IEEE MTT-S Digest, pp. 595-598, 1988.

Young, Leo, *The analytical equivalence of TEM-mode directional couplers and transmission-line stepped-impedance filters*, Proceedings IEEE, vol. 110, No. 2, pp. 275-281, Feb. 1963.

Levy, Ralph, *General Synthesis of Asymmetric Multi-Element Coupled-Transmission-Line Directional Couplers*,* IEEE Transactions on Microwave Theory and Techniques, vol. MTT-11, No. 4, pp. 226-237, Jul. 1963.

Monteath, G.D., *Coupled Transmission Lines as Symmetrical Directional Couplers*, Proc. IEE, vol. 102, Part B, No. 3, pp. 383-392, May 1955.

Oliver, Bernard M., *Directional Electromagnetic Couplers*,* Proc. IRE, vol. 42, No. 11, pp. 1686-1692, Nov. 1954.

Gerst, C.W., *11-7 Electrically Short 90° Couplers Utilizing Lumped Capacitors*, Syracuse University Research Corporation, pp. 58-62, (year unknown).

* cited by examiner

Fig. 1
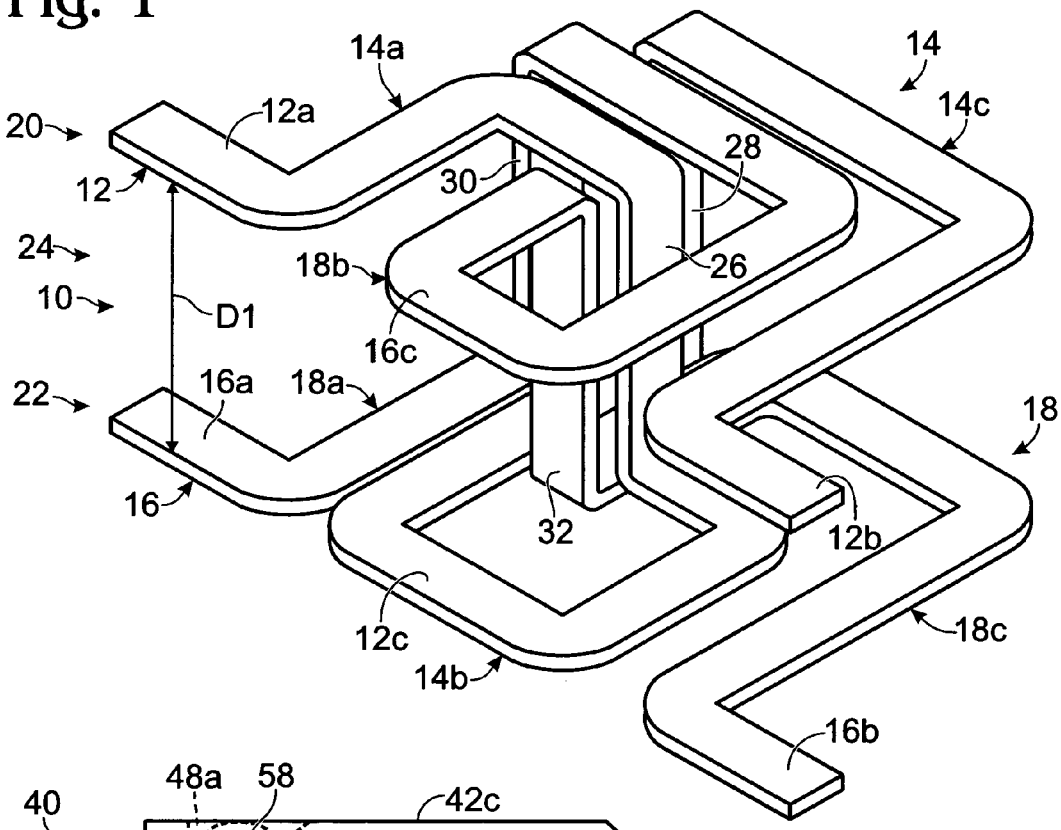
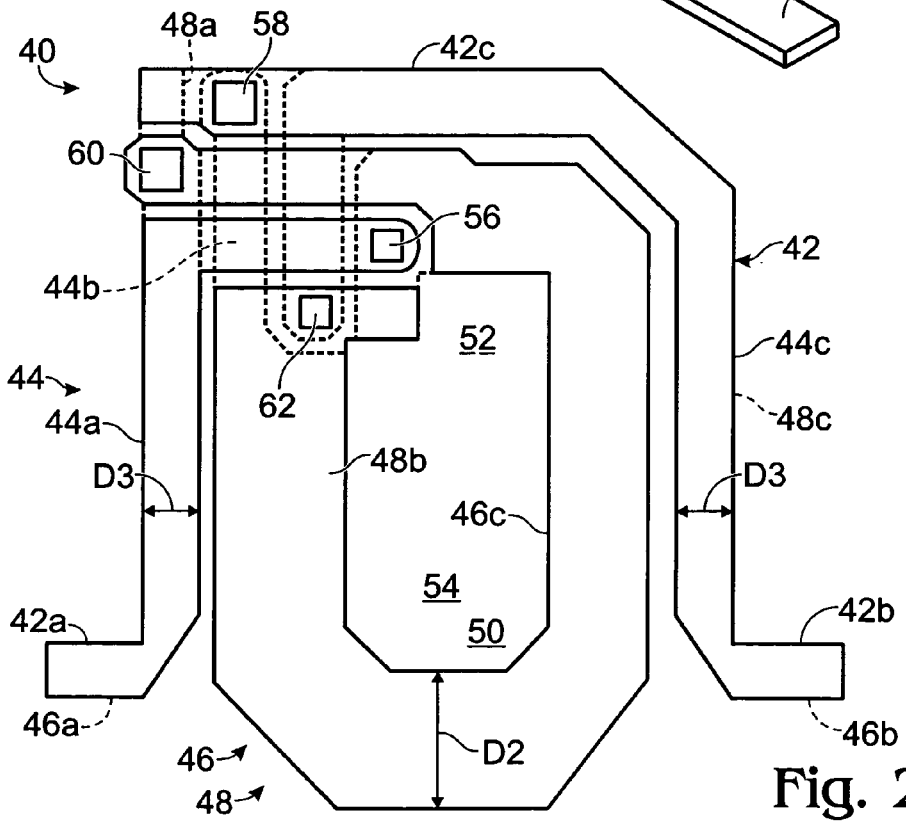
Fig. 2

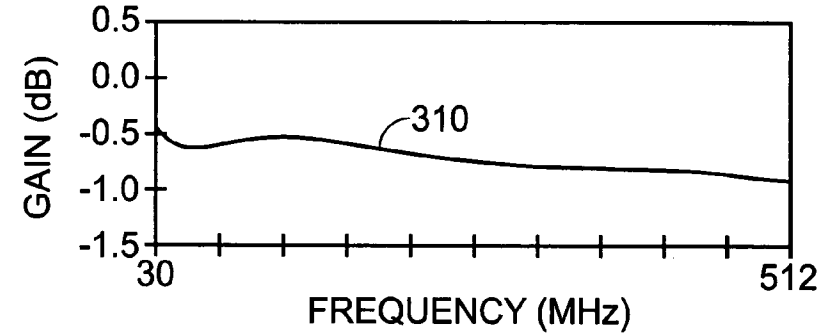
Fig. 14
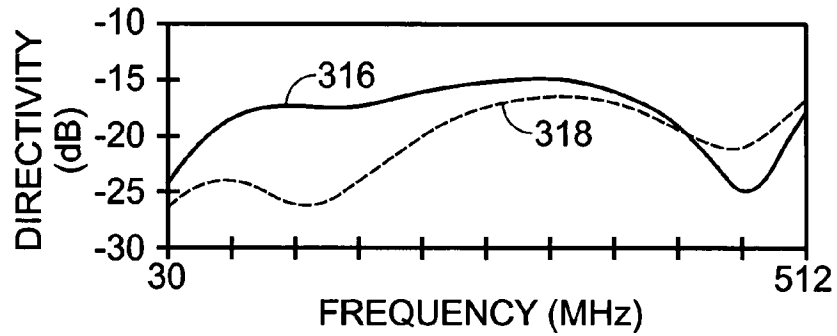
Fig. 16
Fig. 15
Fig. 17

PHASE INVERTER AND COUPLER ASSEMBLY

RELATED APPLICATIONS

This application is a continuation-in-part of U.S. patent application Ser. No. 10/731,174, filed on Dec. 8, 2003. This application is incorporated by reference for all purposes.

BACKGROUND

A pair of conductive lines are coupled when they are spaced apart, but spaced closely enough together for energy flowing in one to be induced in the other. The amount of energy flowing between the lines is related to the dielectric medium the conductors are in and the spacing between the lines. Even though electromagnetic fields surrounding the lines are theoretically infinite, lines are often referred to as being closely or tightly coupled, loosely coupled, or uncoupled, based on the relative amount of coupling.

Couplers are electromagnetic devices formed to take advantage of coupled lines, and may have four ports, such as one port associated with each end of two coupled lines. A main line has an input connected directly or indirectly to an input port. The other end is connected to the direct port. The other or auxiliary line extends between a coupled port and an isolated port. A coupler may be reversed, in which case the isolated port becomes the input port and the input port becomes the isolated port. Similarly, the coupled port and direct port have reversed designations.

Directional couplers are four-port networks that may be simultaneously impedance matched at all ports. Power may flow from one or the other input port to a corresponding output port or output ports, and if the output ports are properly terminated, the ports of the input pair are isolated. A hybrid coupler may generally be assumed to divide the output power equally between the outputs, whereas a directional coupler, as a more general term, may have unequal outputs. Often, the coupler has very weak coupling to a coupled output, which reduces the insertion loss from the input to the main or direct output. One measure of the quality of a directional coupler is its directivity, which is a measure of the desired coupled output to an isolated port output.

Adjacent parallel transmission lines can couple both electrically and magnetically. The coupling is inherently proportional to frequency, and the directivity can be high if the magnetic and electric couplings are equal. Longer coupling regions can increase the coupling between lines, until the vector sum of the incremental couplings no longer increases, and the coupling will decrease with increasing electrical length in a sinusoidal fashion. In many applications it is desired to have a constant coupling over a wide band. Symmetrical couplers exhibit inherently a 90-degree phase difference between the coupled output ports, whereas asymmetrical couplers have phase differences that approach zero-degrees or 180-degrees.

Unless ferrite or other high permeability materials are used, greater than octave bandwidths at higher frequencies are generally achieved with cascading couplers. In a uniform long coupler the coupling rolls off when the length exceeds one-quarter wavelength, and only an octave bandwidth is practical for +/−0.3 dB coupling ripple. If three equal length couplers are connected as one long coupler, with the two outer sections being equal in coupling and much weaker than the center coupling, a wideband design results. At low frequencies all three couplings add. At higher frequencies the three sections can combine to give reduced coupling at the center frequency, where each coupler is one-quarter wavelength. This design may be extended to many sections to obtain a very large bandwidth.

Two characteristics exist with the cascaded coupler approach. One is that the coupler becomes very long and lossy, since its combined length is about one-quarter wavelength long at the lowest band edge. Further, the coupling of the center section gets very tight, especially for 3 dB multi-octave couplers. A cascaded coupler of X:1 bandwidth is about X quarter wavelengths long at the high end of its range. As an alternative, the use of lumped, but generally higher loss, elements has been proposed.

An asymmetrical coupler with a continuously increasing coupling that abruptly terminates at the end of the coupled region will behave differently from a symmetrical coupler. Instead of a constant 90-degree phase difference between the output ports, close to zero or 180 degrees phase difference can be realized. If only the magnitude of the coupling is important, this coupler can be shorter than a symmetric coupler for a given bandwidth, perhaps two-thirds or three-fourths the length.

Most cascaded-line couplers, other than lumped element versions, are designed using an analogy between stepped impedance couplers and transformers. As a result, the couplers are made in stepped sections that each have a length of one-fourth wavelength of a center design frequency, and may be several sections long. The coupler sections may be combined into a smoothly varying coupler. This design theoretically raises the high frequency cutoff, but it does not reduce the length of the coupler.

BRIEF SUMMARY OF THE DISCLOSURE

A circuit assembly is disclosed that may include first and second multi-port coupler sections, and a phase inverter. The phase inverter may be coupled between a first port of the first coupler section and a first port of the second coupler section. The phase inverter may be adapted substantially to invert the phase of a signal in a manner that also delays the signal. A phase shifter may be coupled between a second port of the first coupler section and a second port of the second coupler section. The phase shifter may be adapted to delay a signal input into the phase shifter by an amount that corresponding to the delay in the phase inverter.

In some examples, Such as for a phase inverter, a circuit assembly may include first and second conductors each having first and second ends, and a capacitive device coupling the first ends of the first and second conductors to a reference potential. The conductors may form mutually inductively coupled turns. The first and second conductors and the capacitive device may be adapted to invert substantially the phase of a signal input on one of the second ends, and to produce the substantially phase-inverted signal on the other of the second ends.

BRIEF DESCRIPTION OF THE SEVERAL FIGURES

FIG. 1 is a simplified illustration of a spiral-based coupler.

FIG. 2 is a plan view of a coupler formed on a substrate.

FIG. 14 is a graph of gain for a coupler assembly made with the circuit structure of FIG. 10.

FIG. 15 is a graph of coupling for a coupler assembly made with the circuit structure Of FIG. 10.

FIG. 16 is a graph of directivity for a coupler assembly made with the circuit structure of FIG. 10.

FIG. 17 is a graph of voltage standing wave ratio for a coupler assembly made with the circuit structure of FIG. 10.

DETAILED DESCRIPTION OF VARIOUS EMBODIMENTS

Figure 3:
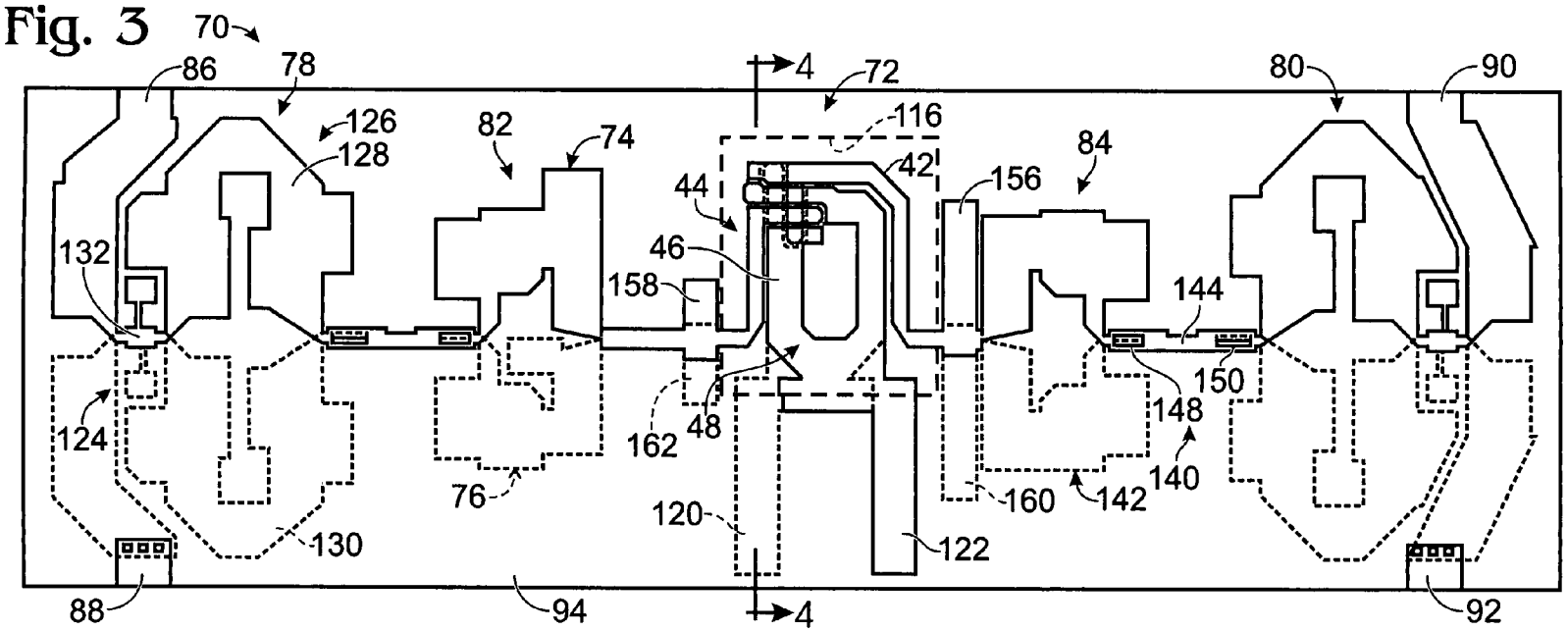
FIG. 3 is a plan view of a coupler incorporating the coupler of FIG. 2.

Two coupled lines may be analyzed based on odd and even modes of propagation. For a pair of identical lines, the even mode exists with equal voltages applied to the inputs of the lines, and for the odd mode, equal out-of-phase voltages. This model may be extended to non-identical lines, and to multiple coupled lines. For high directivity in a 50-ohm system, for example, the product of the characteristic impedances of the odd and even modes, e.g., Zoe*Zoo is equal to $Zo^2$, or 2500 ohms. Zo, Zoe, and Zoo are the characteristic impedances of the coupler, the even mode and the odd mode, respectively. Moreover, the more equal the velocities of propagation of the two modes are, the better the directivity of the coupler.

A dielectric above and below the coupled lines may reduce the even-mode impedance while it may have little effect on the odd mode. Air as a dielectric, having a dielectric constant of 1, may reduce the amount that the even-mode impedance is reduced compared to other dielectrics having a higher dielectric constant. However, fine conductors used to make a coupler may need to be supported.

Spirals may also increase the even-mode impedance for a couple of reasons. One reason is that the capacitance to ground may be shared among multiple conductor portions. Further, magnetic coupling between adjacent conductors raises their effective inductance. The spiral line is also smaller than a straight line, and easier to support without impacting the even mode impedance very much. However, using air as a dielectric above and below the spirals while supporting the spirals on a material having a dielectric constant greater than 1 may produce a velocity disparity, because the odd mode propagates largely through the dielectric between the coupled lines, and is therefore slowed down compared to propagation in air, while the even mode propagates largely through the air.

The odd mode of propagation is as a balanced transmission line. In order to have the even and odd mode velocities equal, the even mode needs to be slowed down by an amount equal to the reduction in velocity introduced by the dielectric loading of the odd mode. This may be accomplished by making a somewhat lumped delay line of the even mode. Adding capacitance to ground at the center of the spiral section produces an L-C-L low pass filter. One way of accomplishing this is by widening the conductors in the middle or intermediate portion of the spirals. The coupling between halves of the spiral modifies the low pass structure into a nearly all-pass "T" section. When the electrical length of the spiral is large enough, such as greater than one-eighth of the wavelength of a design center frequency, the spiral may not be considered to function as a lumped element. It becomes a nearly all-pass transmission-line structure. The delay of the nearly all pass even mode and that of the balanced dielectrically loaded odd mode may be made approximately equal over a decade bandwidth.

As the design center frequency is reduced, it is possible to use more turns in the spiral to make it more lumped and all-pass, with better behavior at the highest frequency. Physical scaling down also may allow more turns to be used at high frequencies, but the dimensions of traces, vias, and the dielectric layers may become difficult to realize.

FIG. 1 illustrates a coupler 10 based on these concepts, having a first conductor 12 forming a first spiral 14, and a second conductor 16 forming a second spiral 18. Although many spiral configurations may be realized, in the example shown, mutually inductively coupled spirals 14 and 18 are disposed on first and second levels 20 and 22, with a dielectric layer 24 between the two levels. Spiral 14 may include a first or end portion 14*a* on level 20, a second or intermediate portion 14*b* on level 22, and a third or end portion 14*c* on level 20. Similarly, spiral 18 may include a first or end portion 18*a* on level 22, a second or intermediate portion 18*b* on level 20, and a third or end portion 18*c* on level 22. Correspondingly, conductor 12 may have ends 12*a* and 12*b*, and spiral 14 may be considered to be an intermediate conductor portion 12*c*; and conductor 16 may have ends 16*a* and 16*b*, and spiral 18 may be considered to be an intermediate conductor portion 16*c*. Ends 12*a* and 12*b*, and 16*a* and 16*b* may also be considered to be respective input and output terminals for the associated spirals.

Spiral 14 further includes an interconnection 26 interconnecting portion 14*a* on level 20 with portion 14*b* on level 22; an interconnection 28 interconnecting portion 14*b* on level 22 with portion 14*c* on level 20; an interconnection 30 interconnecting portion 18*a* on level 22 with portion 18*b* on level 20; and an interconnection 32 interconnecting portion 18*b* on level 20 with portion 18*c* on level 22. The coupling level of the coupler is affected by spacing D1 between levels 20 and 22, corresponding to the thickness of dielectric layer 24, as well as the effective dielectric constant of the dielectric surrounding the spirals, including layer 24. These dielectric layers between, above and below the spirals may be made of an appropriate material or a combination of materials and layers, including air and various solid dielectrics.

A plan view of a specific coupler 40, similar to coupler 10 and that realizes features discussed above, is illustrated in FIG. 2. Coupler 40 includes a first conductor 42 forming a first spiral 44, and a second conductor 46 forming a second spiral 48. In this example, spirals 44 and 48 are disposed on first and second surfaces 50 and 52 of a dielectric substrate 54 between the two levels. Conductors on hidden surface 52 are identical to and lie directly under (overlap) conductors on visible surface 50, except for those conductors shown in dashed lines. Spiral 44 may include a first or end portion 44*a* on surface 50, a second or intermediate portion 44*b* on surface 52, and a third or end portion 44*c* on surface 50. Similarly, spiral 48 may include a first or end portion 48*a* on surface 52, a second or intermediate portion 48*b* on surface 50, and a third or end portion 48*c* on surface 52. Correspondingly, conductor 42 may have ends 42*a* and 42*b*, and spiral 44 may be considered to be an intermediate conductor portion 42*c*; and conductor 46 may have ends 46*a* and 46*b*, and spiral 48 may be considered to be an intermediate conductor portion 46*c*. Ends 42*a* and 42*b*, and 46*a* and 46*b* may also be considered to be respective input and output terminals for each of the associated spirals.

Spiral 44 further includes a via 56 interconnecting portion 44*a* on surface 50 with portion 44*b* on surface 52; a via 58 interconnecting portion 44*b* on surface 52 with portion 44*c* on surface 50; a via 60 interconnecting portion 48*a* on surface 52 with portion 48*b* on surface 50; and a via 62 interconnecting portion 48*b* on surface 50 with portion 48*c* on surface 52.

Intermediate portions 44*b* and 48*b* of the spirals have widths D2, and end portions 44*a*, 44*c*, 48*a* and 48*c* have a width D3. It is seen that width D3 is nominally about half of width D2. The increased size of the conductors in the middle of the spirals, provide increased capacitance compared to the capacitance along the ends of the spirals. As discussed above, this makes the coupler more like an L-C-L low pass filter. Further, it is seen that each spiral has about 7/4 turns. The increased turns over a single-turn spiral, also as discussed, make the spiral function in the even mode more like a lumped all-pass network, and thereby in combination with the other conductor spiral, more of an all-pass "coupler".

Figure 4:
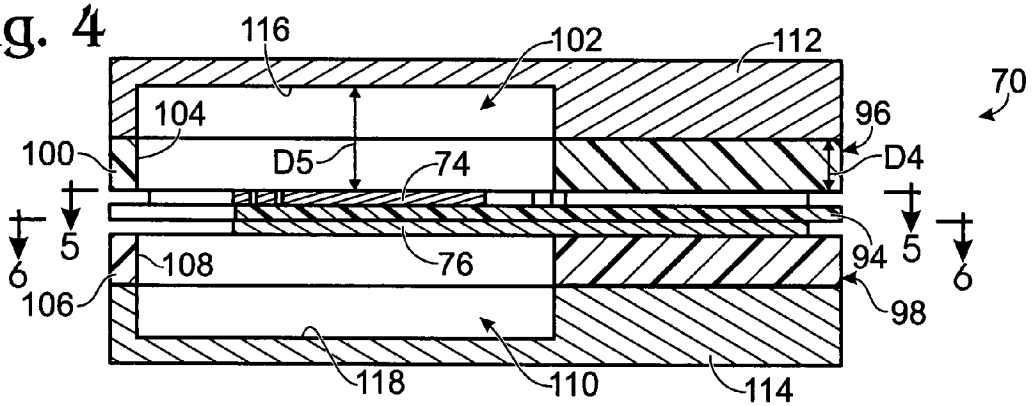
FIG. 4 is a cross section taken along line 4—4 of FIG. 3.
Figure 5:
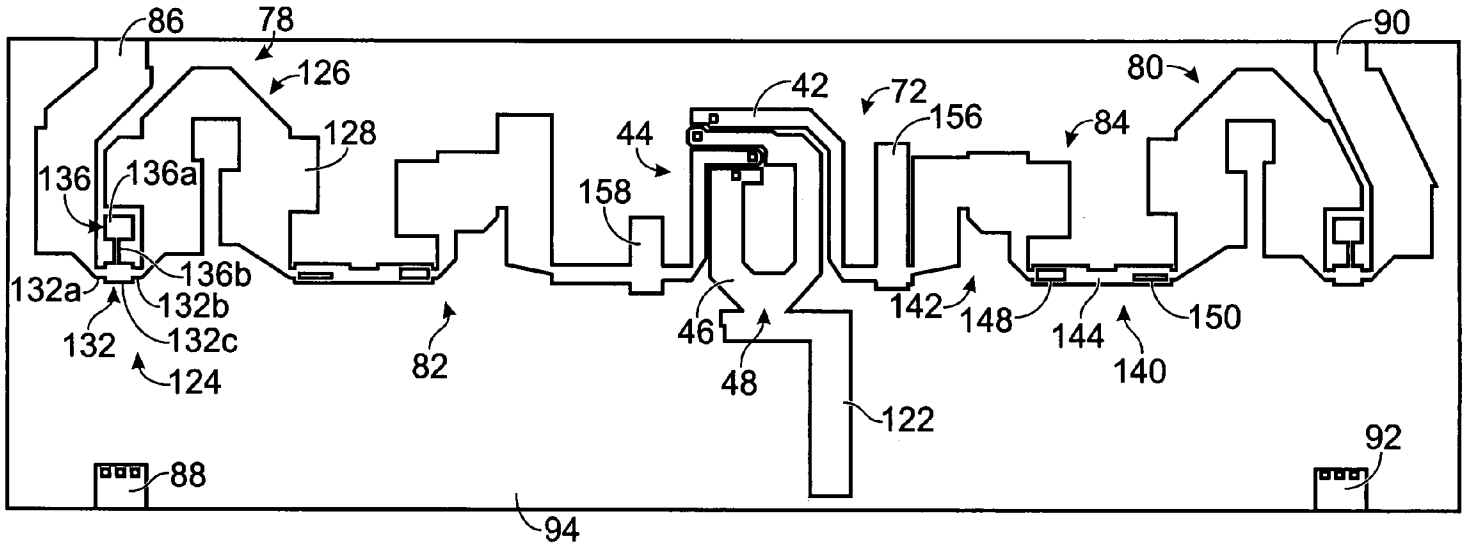
FIG. 5 is a plan view of a first conductive layer of the coupler taken along line 5—5 of FIG. 4.
Figure 6:
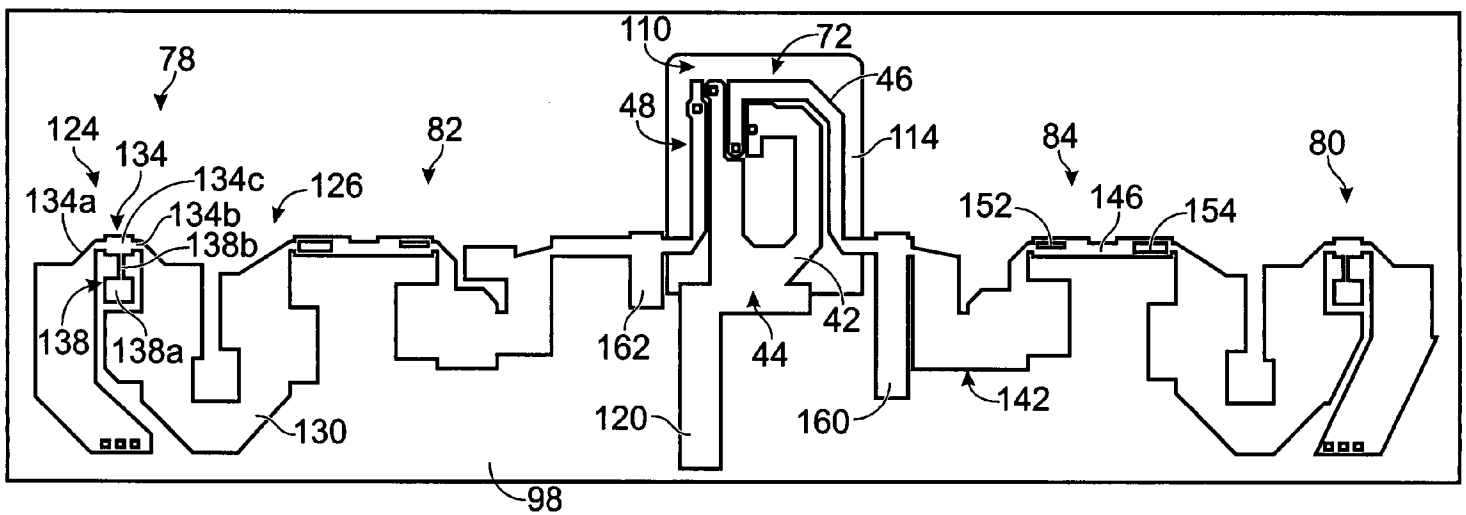
FIG. 6 is a plan view of a second conductive layer of the coupler taken along line 6—6 of FIG. 4.

Coupler 40 may thus form a 50-ohm tight coupler. A symmetrical wideband coupler can then be built with 3, 5, 7, or 9 sections, with the spiral coupler section forming the center section. The center section coupling may primarily determine the bandwidth of the extended coupler. An example of such a coupler 70 is illustrated in FIGS. 3–6. FIG. 3 is a plan view of coupler 70 incorporating the coupler of FIG. 2 as a center coupler section 72. The reference numbers for coupler 40 are used for the same parts of section 72. FIG. 4 is a cross section taken along line 4—4 of FIG. 3 showing an example of additional layers of the coupler. FIG. 5 is a plan view of a first conductive layer 74 of the coupler of FIG. 3, as viewed along line 5—5 in FIG. 4. FIG. 6 is a plan view of a second conductive layer 76 of the coupler of FIG. 3, as viewed along line 6—6 in FIG. 4 at the transition between the conductive layer and a substrate between the two conductive layers.

Referring initially to FIG. 3, coupler 70 is a hybrid quadrature coupler and has four coupler sections in addition to center section 72. The four additional coupler sections include outer coupler sections 78 and 80, and intermediate coupler sections 82 and 84. Outer section 78 is coupled to first and second ports 86 and 88. Outer section 80 is coupled to third and fourth ports 90 and 92. Ports 86 and 88 may be the input and coupled ports and ports 90 and 92 the direct and isolated ports, in a given application. Depending on the use and connections to the coupler, these port designations may be reversed from side-to-side, or end-to-end. That is, ports 86 and 88 may be the coupled and input ports, respectively, or ports 90 and 92, or ports 92 and 90, respectively, may be the input and coupled ports. Variations may also be made in the conductive layers to vary the location of output ports. For instance, by flipping the metallization of ports 90 and 92, optionally including one or more adjacent coupler sections, the coupled and direct ports 88 and 90 are on the same side of the coupler.

As shown in FIG. 4, coupler 70 may include a first, center dielectric substrate 94. Substrate 94 may be a single layer or a combination of layers having the same or different dielectric constants. In one example, the center dielectric is less than 30 mils thick and is formed of, for example, a suitable material made by Polyflon Company of Norwalk, Conn., U.S.A., such as that referred to by the trademark TEFLON™. Optionally, for a frequency range of about 200 MHz to about 2 GHz, the dielectric may be less than 10 mils thick, with thicknesses of about 5 mils, such as 4.5 mils, having been realized. The dimensions Of the dielectric and the length, width and spacing of coupler conductors as described below, generally are determined by balancing such factors as ease of fabrication, insertion loss and frequency response. Increasing the thickness of the dielectric may result in increased parasitics, which adversely affect the frequency response. For example, in a coupler designed for operation over a frequency range of 30 MHz to 512 MHz, a dielectric thickness of 10 mils may be used and lower insertion loss may be realized by increasing line widths. For even lower frequencies, further increased thicknesses may be used, such as 30 mils. Other frequencies could also be used, such as between 100 MHz and 1 GHz, or a frequency greater than 1 GHz, depending on manufacturing tolerances.

First conductive layer 74 is positioned on the top surface of the center substrate 94, and second conductive layer 76 is positioned on the lower surface of the center substrate. Optionally, the conductive layers could be self-supporting, or supporting dielectric layers could be positioned above layer 74 and below layer 76.

A second dielectric layer 96 is positioned above conductive layer 74, and a third dielectric layer 98 is positioned below conductive layer 76, as shown. Layer 96 includes a solid dielectric substrate 100 and a portion of an air layer 102 positioned over first and second spirals 44 and 48. Air layer 102 in line with substrate 100 is defined by an opening 104 extending through the dielectric. Third dielectric layer 98 is substantially the same as dielectric layer 96, including a solid dielectric substrate 106 having an opening 108 for an air layer 110. Dielectric substrates 100 and 106 may be any suitable dielectric material. In high power applications, heating in the narrow traces of the spirals may be significant. An alumina or other thermally conductive material can be used for dielectric substrates 100 and 106 to support the spiral at the capacitive middle section, and to act as a thermal shunt while adding capacitance.

A circuit ground or reference potential may be provided on each side of the second and third dielectric layers by respective conductive substrates 112 and 114. Substrates 112 and 114 contact dielectric substrates 100 and 106, respectively. Conductive substrates 112 and 114 include recessed regions Or cavities 116 and 118, respectively, into which air layers 102 and 110 extend. As a result, the distance D4 from each conductive layer 74 and 76 to the respective conductive substrates 112 and 114, which may function as ground planes, is less than the distance D5 of air layers 102 and 110, respectively. In one embodiment of coupler 70, the distance D4 is 0.062 mils or $1/16^{th}$ inch, and the distance D5 is 0.125 mils or $1/8^{th}$ inch.

As shown particularly in FIGS. 5 and 6, extensions or tabs 120 and 122 extend from respective intermediate spiral portions 44*b* and 48*b* of coupler sections 78 and 80. Tabs 120 and 122 extend from different positions of the spirals so that they do not overlap each other. As a result, they do not affect the coupling between the spirals and increase the capacitance to ground. This forms, with the inductance of the spiral, an all-pass network for the even mode.

Outer coupler sections 78 and 80 are mirror images of each other. Accordingly, only coupler section 78 will be described, it being understood that the description applies equally well to coupler section 80. Coupler section 78 includes a tightly coupled portion 124 and an uncoupled portion 126. This general design is discussed in my copending U.S. patent application Ser. No. 10/607,189 filed Jun. 25, 2003, which is incorporated herein by reference. The uncoupled portion 126 includes delay lines 128 and 130 extending in opposite directions as part of conductive layers 74 and 76, respectively. Coupled portion 124 includes overlapping conductive lines 132 and 134, on respective conductive layers, connected, respectively, between port 86 and delay line 128, and between port 88 and delay line 130. Line 132 includes narrow end portions 132*a* and 132*b*, and a wider intermediate portion 132*c*. Line 134 includes similar end portions 134*a* and 134*b*, and an intermediate portion 134*c*.

Couplers having broadside coupled parallel lines, such as coupled lines 132 and 134, in the region of divergence of the coupled lines between end portions 132*a* and 134*a* and associated ports 86 and 88, exhibit inter-line capacitance. As the lines diverge, magnetic coupling is reduced by the cosine of the divergence angle and the spacing, while the capacitance simply reduces with increased spacing. Thus, the line-to-line capacitance is relatively high at the ends of the coupled region.

This can be compensated for by reducing the dielectric constant of the center dielectric in this region, such as by drilling holes through the center dielectric at the ends of the coupled region. This, however, has limited effectiveness. For short couplers, this excess "end-effect" capacitance could be considered a part of the coupler itself, causing a lower odd mode impedance, and effectively raising the effective dielectric constant, thereby slowing the odd mode propagation.

In the embodiment shown, additional capacitance to ground is provided at the center of the coupled region by tabs 136 and 138, which extend in opposite directions from the middle of respective intermediate coupled-line portions 132*c* and 134*c*. This capacitance lowers the even mode impedance and slows the even mode wave propagation. If the even and the Odd mode velocities are equalized, the coupler can have a high directivity. The reduced width of coupled line ends 132*a*, 132*b*, 134*a* and 134*b* raises the even mode impedance to an appropriate value. This also raises the odd mode impedance, so there is some optimization necessary to arrive at the correct shape of the coupled to uncoupled transition when capacitive loading at the center of the coupler is used for velocity equalization.

Tab 136 includes a broad end 136*a* and a narrow neck 136*b*, and correspondingly tab 138 includes a broad end 138*a* and 138*b*. The narrow necks cause the tabs to have little effect on the magnetic field surrounding the coupled section. The shape of the capacitive connection to the center of the coupler is thus like a balloon, or a flag, with the thin flag pole (narrow neck) attached at the center of the coupled region to one conductor on one side of the center circuit board, and to the other conductor on the other side of the circuit board, directly opposite the first flag. It is important that the flags do not couple; therefore they connect to opposite edges of the coupled lines, rather than on top of one another.

Intermediate coupler sections 82 and 84 are also mirror images of each other, so coupler section 84 is described With the understanding that section 82 has the same features. Coupler section 84 includes a tightly coupled portion 140 and an uncoupled portion 142. As seen particularly in FIGS. 5 and 6, tightly coupled portion 140 includes a coupled line 144 in conductive layer 74, and a coupled line 146 in conductive layer 76. Each coupled line in the intermediate coupler sections has a pair of elongate holes, a larger hole and a smaller hole. Specifically, coupled line 144 includes a larger hole 148 adjacent to uncoupled section 142 and a smaller hole 150 at the other end of the coupled line. Coupled line 146 has a smaller hole 152 generally aligned with hole 148 and a larger hole 154 generally aligned with hole 150. Further, the width of each coupled line is reduced in an intermediate region between the holes. These holes reduce the capacitance produced by the coupled lines in the odd mode, while leaving the inductance essentially the same. Similar to coupler section 78, this tends to equalize the odd and even mode velocities in the coupled section.

First and second conductive layers 74 and 76 further have various tabs extending from them, such as tabs 156 and 158 on conductive layer 74, and tabs 160 and 162 on conductive layer 76. These various tabs provide tuning of the coupler to provide desired odd and even mode impedances and substantially equal velocities of propagation of the odd and even modes.

Figure 7:
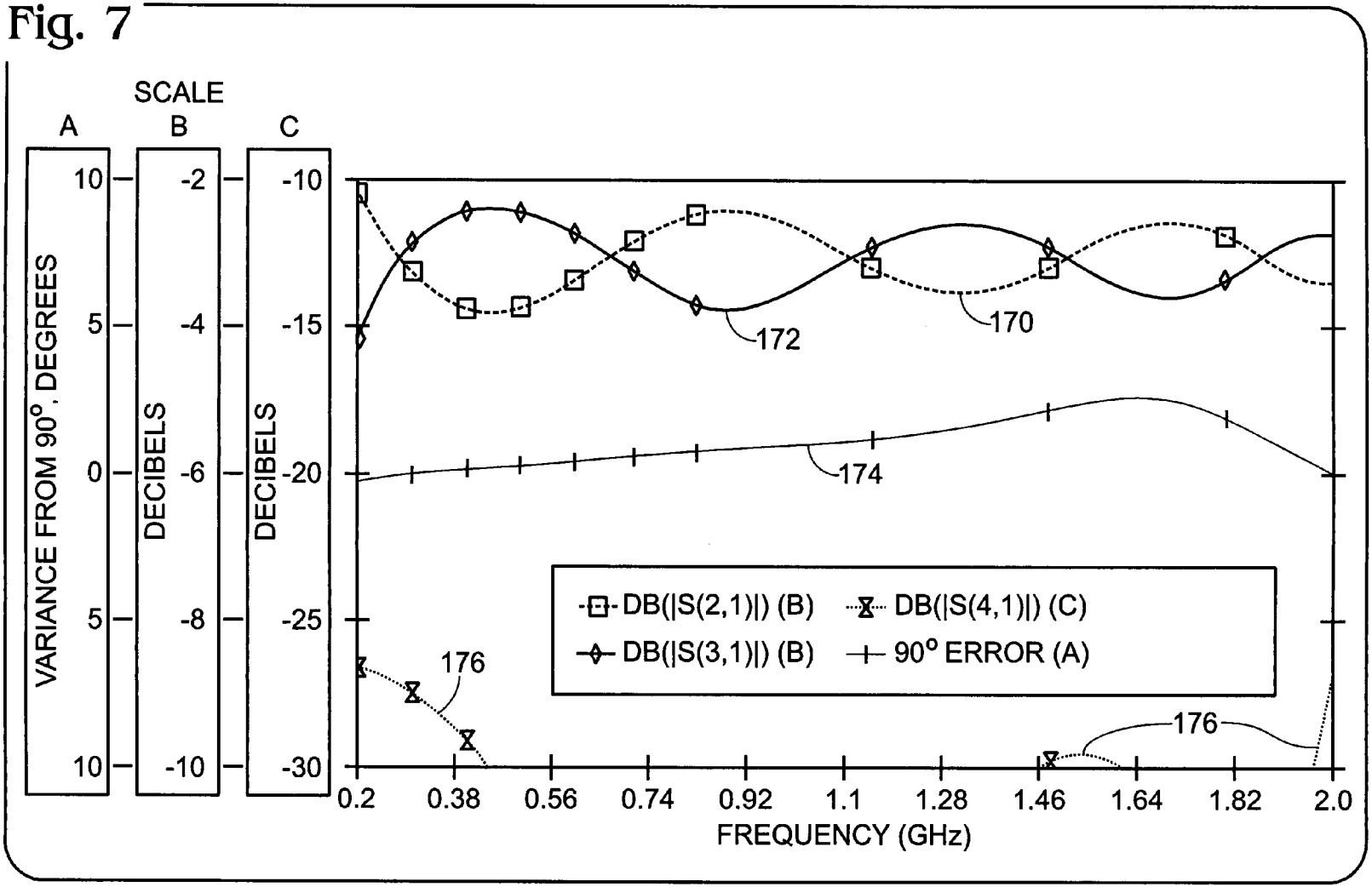
FIG. 7 is a plot of selected operating parameters simulated as a function of frequency for a coupler corresponding to the coupler of FIG. 3.

Various operating parameters over a frequency range of 0.2 GHz to 2.0 GHz are illustrated in FIG. 7 for coupler 70 with a 5-mil thick dielectric substrate 94 and a 125-mil thickness for air layers 102 and 110. Three scales for the vertical axis, identified as scales A, B and C, apply to the various curves. Curve 170 represents the gain on the direct port and curve 172 represents the gain on the coupled port. Scale B applies to both of these curves. It is seen that the curves have a ripple of about +/−0.5 dB about an average of about −3 dB. Since a coupler is a passive device the gain is negative. The absolute value may also be referred to as insertion loss. For consistency, the term "gain" is used.

As a quadrature coupler, a 90-degree phase difference ideally exists between the direct and coupled ports for all frequencies. Curve 174, to which scale A applies, shows that the variance from 90 degrees gradually reaches a maximum of about 2.8 degrees at about 1.64 GHz. Finally, only a portion of a curve 176 is visible at the bottom of the chart. Scale C applies to curve 176, which curve indicates the isolation between the input and isolated ports. It is seen to be less than −30 dB over most of the frequency range, and below −25 dB for the entire frequency range.

Many variations are possible in the design of a coupler including one or more of the various described features. Other coupler sections can also be used in coupler 70, such as conventional tightly and loosely coupled sections. Other variations may be used in a particular application, and may be in the form of symmetrical or asymmetrical couplers, and hybrid or directional couplers.

Figure 8:
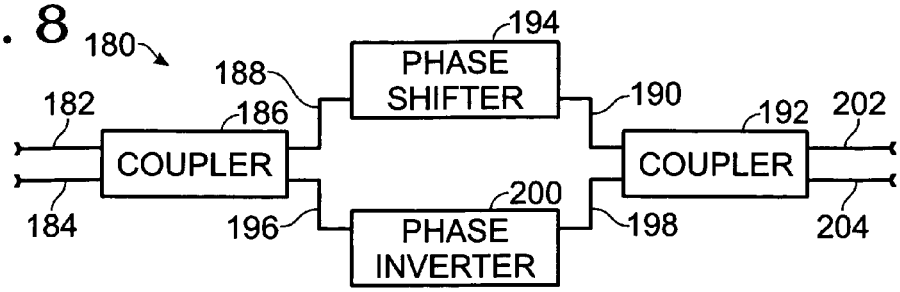
FIG. 8 is a simplified illustration of a coupler assembly including couplers and a phase inverter.

One example of a further coupler configuration is a circuit or coupler assembly 180 depicted in FIG. 8. Coupler assembly 180, which also may be a coupler or may be a portion of a larger coupler, may include first and second ports 182 and 184 connected to a first coupler or coupler section 186. A third port 188 of coupler section 186 may be coupled to a first port 190 of a second coupler or coupler section 192 via a phase shifter 194. A fourth port 196 of coupler section 186 may be coupled to a second port 198 of coupler section 192 via a phase inverter 200. Coupler section 192 also may include third and fourth ports 202 and 204. When coupler assembly 180 is used as a coupler, ports 182, 184, 202 and 204 may also variously be input, coupled, direct, and uncoupled ports, depending on the application.

If coupler section 186 were directly connected to coupler section 192, the coupler sections would produce a resulting coupling that is the vector sum of the two coupler sections. A coupler section may provide coupling over a pass band. Two coupling sections connected in tandem, then, may form a coupler having a more narrow pass band. By inserting a phase inverter 200 between coupler sections, the coupler sections may produce a resulting coupling that is the vector difference of the coupling of the two coupler sections. This may extend the pass band of the combined coupler assembly, and may produce a flatter response than the individual coupler sections have. Further, by making the phase inverter tightly coupled at the mid-band, additional ripple may be added to the response, making the bandwidth even wider. A phase shifter 194 may be added in the other connection between the coupler sections to compensate for delay in signal propagation through the phase inverter.

Figure 9:
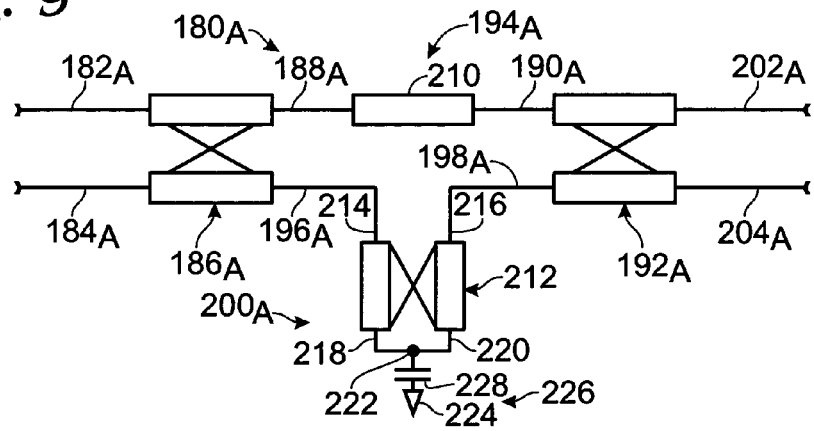
FIG. 9 is a further general illustration of a coupler assembly including coupler sections.

FIG. 9 illustrates a further example of a coupler assembly $\mathbf{180}_A$, also referred to as a circuit assembly, including a first coupler section $\mathbf{186}_A$, a second coupler section $\mathbf{192}_A$, a phase shifter $\mathbf{194}_A$, and a phase inverter $\mathbf{200}_A$. Coupler assembly $\mathbf{180}_A$ also has ports $\mathbf{182}_A$, $\mathbf{184}_A$, $\mathbf{188}_A$, $\mathbf{190}_A$, $\mathbf{196}_A$, $\mathbf{198}_A$, $\mathbf{202}_A$, and $\mathbf{204}_A$.

A subscript on a reference number, such as subscript A on reference number $\mathbf{180}_A$, indicates an additional embodiment of the subject being referenced. The subject may be the same as or different than other embodiments having the same base reference number, such as base reference number 180. The various embodiments may also be collectively referred to by the common base reference number, such as coupler assemblies 180.

Phase shifter $\mathbf{194}_A$ may include a delay line 210. Phase inverter $\mathbf{200}_A$ may include a third coupler section 212 having ports 214, 216, 218 and 220. In this example, ports 218 and 220 are connected together at a connection 222, which connection is then connected to a reference potential 224, such as ground, through a capacitive device 226. A capacitor 228 is an example of a common capacitive device. Any appropriate device that provides capacitance may be used. A delay in a signal conducted through phase inverter $\mathbf{200}_A$ may be compensated for by adding a corresponding delay with delay line 210.

As discussed above, the inductance in coupler section 212 and capacitance in capacitive device 226 form an L-C-L network that inverts the phase of a signal passing through it. Typically, the phase of the signal is changed to something less than 180° for low frequencies, and then the phase approaches 180° as the frequency increases.

Figure 10:
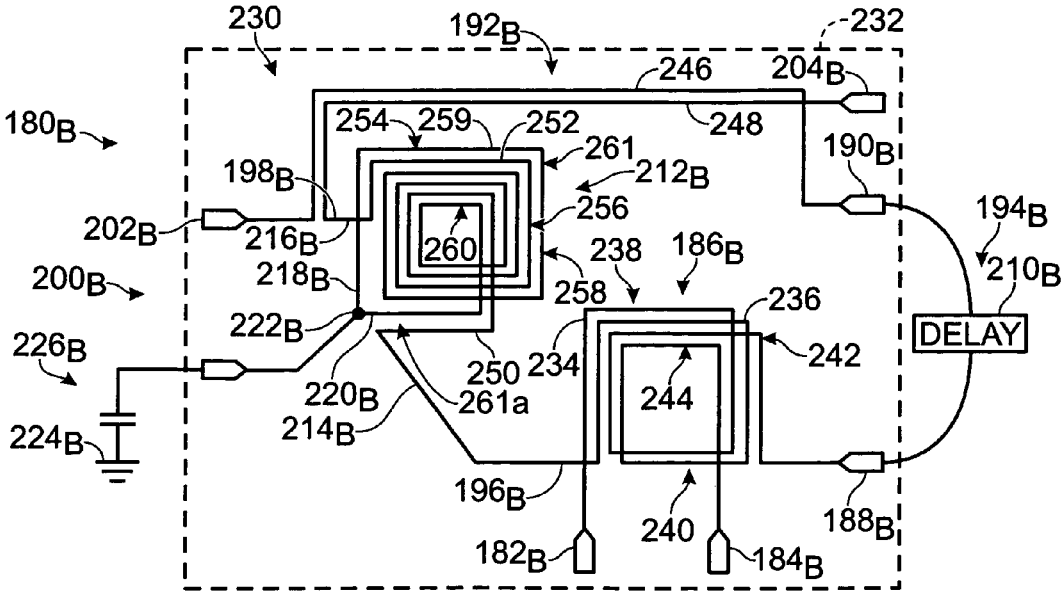
FIG. 10 is a simplified plan view of a coupler assembly including a planar circuit structure including spiral coupler sections.

FIGS. 10–13 illustrate a further embodiment of a coupler or circuit assembly, shown as coupler assembly $\mathbf{180}_B$. FIG. 10 is a simplified illustration showing the assembly in a two-dimensional representation. The others of these figures depict a three-dimensional embodiment. Coupler assembly $\mathbf{180}_B$ may include a first coupler section $\mathbf{186}_B$ a second coupler section $\mathbf{192}_B$, a phase shifter $\mathbf{194}_B$, and a phase inverter $\mathbf{200}_B$. Coupler assembly $\mathbf{180}_B$ also has ports $\mathbf{182}_B$, $\mathbf{184}_B$, $\mathbf{188}_B$, $\mathbf{190}_B$, $\mathbf{196}_B$, $\mathbf{198}_B$, $\mathbf{202}_B$, and $\mathbf{204}_B$. Phase shifter $\mathbf{194}_B$ may include a delay line $\mathbf{210}_B$. Phase inverter $\mathbf{200}_B$ may include a third coupler section $\mathbf{212}_B$ having ports $\mathbf{214}_B$, $\mathbf{216}_B$, $\mathbf{218}_B$ and $\mathbf{220}_B$. In this example, ports $\mathbf{218}_B$ and $\mathbf{220}_8$ are connected together at a connection $\mathbf{222}_B$, which connection is then connected to a reference potential, such as ground, through a capacitive device $\mathbf{226}_B$.

Coupler assembly $\mathbf{180}_B$ may be formed in a generally planar configuration. Further, portions of the assembly, such as circuit assembly 230, may be formed in one or more planar configurations relative to one or more substrate layers, such as a dielectric layer 232 represented by dashed lines. In this example, circuit assembly 230 may include all of coupler assembly $\mathbf{180}_B$ except delay line $\mathbf{210}_B$ and capacitive device $\mathbf{226}_B$. In other examples, coupler assembly $\mathbf{180}_B$ may be entirely on the same substrate, or a plurality of substrates or other circuit structures may be used. The conductors shown in the figure are representative of general configurations. Conductors represented by the various lines may be coplanar or may be formed on two or more planes, such as surfaces of dielectric layers, or may be formed in other circuit configurations. Transitions of conductors across other conductors may be provided using vias, bond wires, air bridges, conductors on and in dielectric layers, and other interconnections.

First coupler section $\mathbf{186}_B$ may include conductors 234 and 236 forming respective mutually inductively coupled spirals 238 and 240 having respective turns 242 and 244. Second coupler section $\mathbf{192}_B$ may include electromagnetically coupled, generally rectilinearly extending conductors 246 and 248. Third coupler section $\mathbf{212}_B$ may include conductors 250 and 252 forming respective mutually inductively coupled spirals 254 and 256 having respective turns 258 and 260. Conductors 250 and 252 may also be considered to form a continuous conductor 259. Similarly, spirals 254 and 256 form a continuous inductive spiral or coil 261 having an intermediate portion 261*a* that includes connection $\mathbf{222}_B$. The ports of the associated coupler sections correspond to the ends of the various conductors and spirals.

Figure 11:
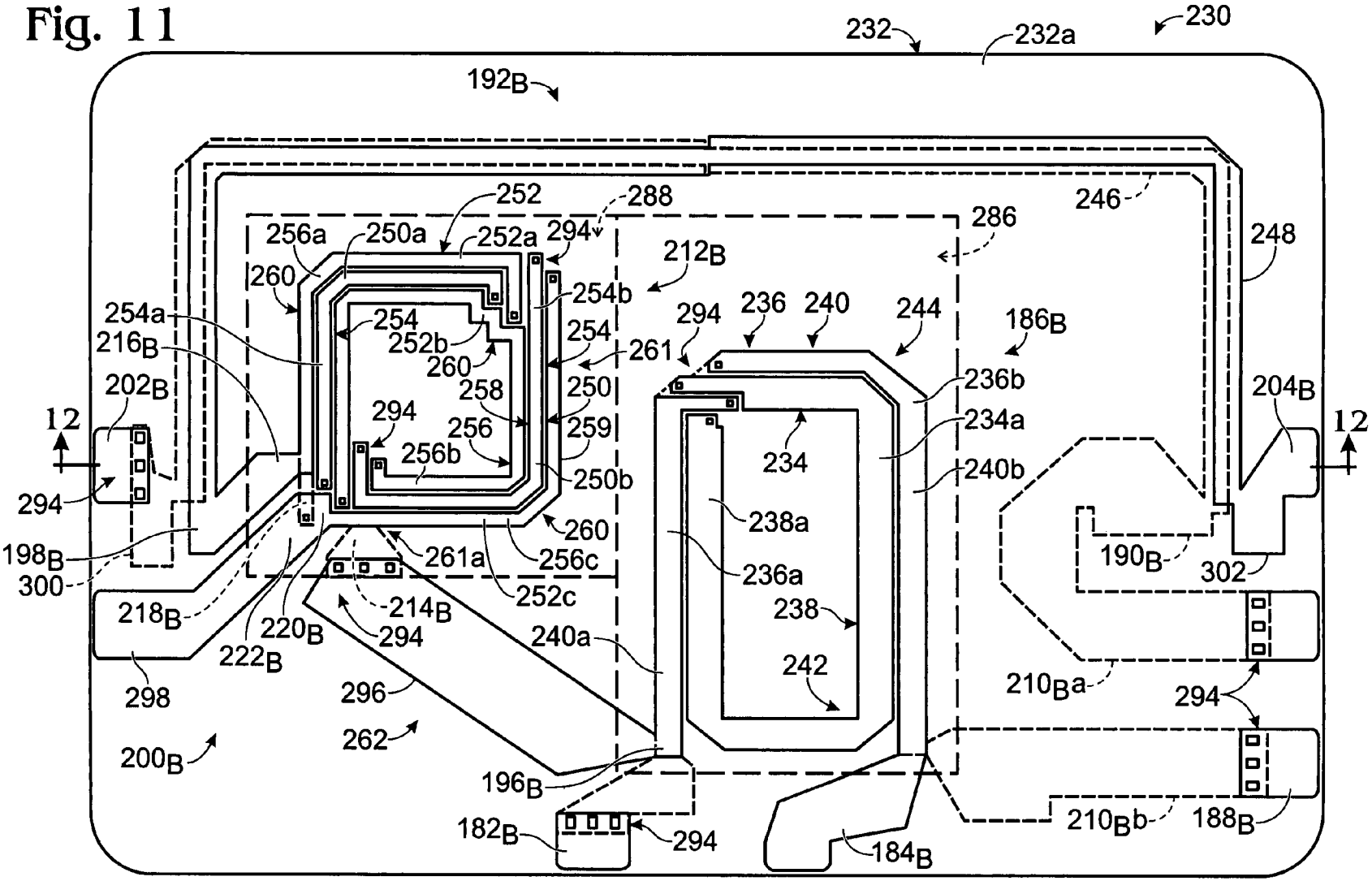
FIG. 11 is a plan view of a planar circuit structure including spiral coupler sections.
Figure 12:
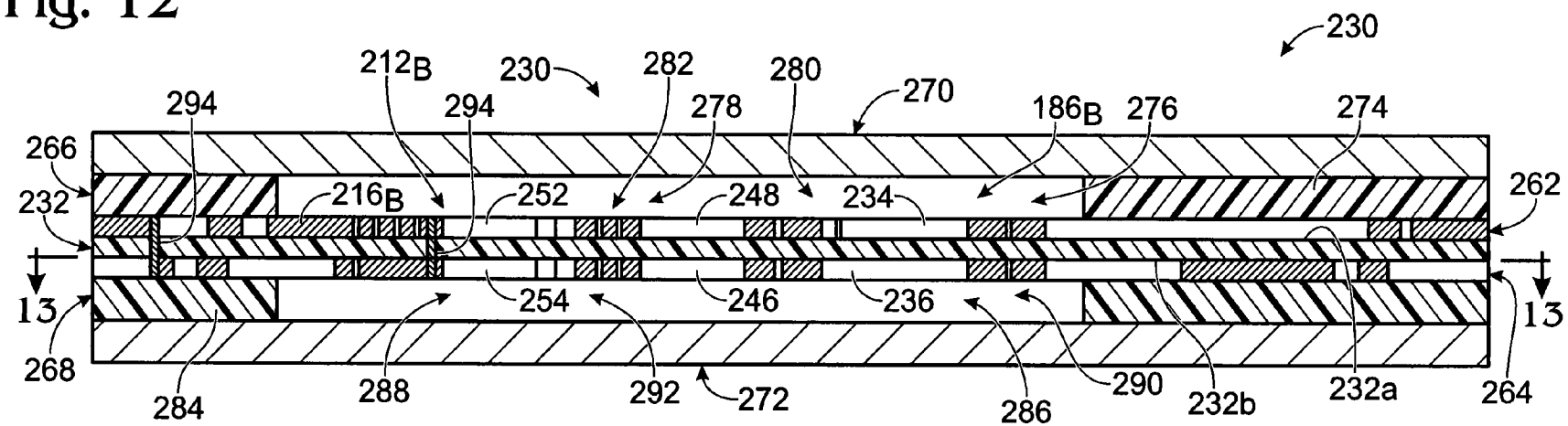
FIG. 12 is a cross section taken along line 12—12 in FIG. 11.
Figure 13:
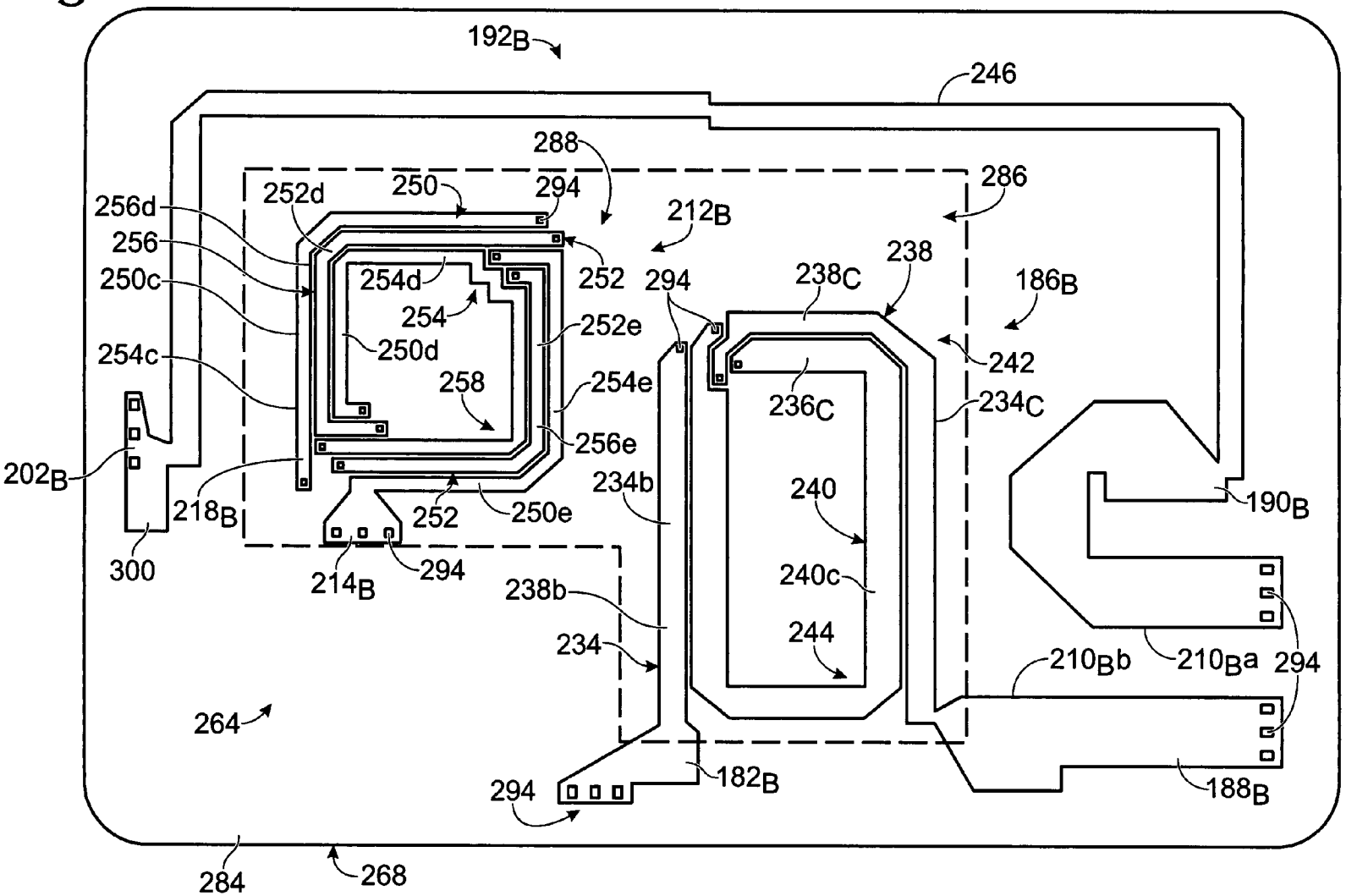
FIG. 13 is a view taken along line 13—13 in FIG. 12.

Referring now more particularly to FIGS. 11–13, and similar to coupler 70 depicted in FIGS. 3–5, circuit assembly 230 may include a dielectric layer 232 similar to dielectric substrate 94, as well as first and second conductive layers 262 and 264, second and third dielectric layers 266 and 268, and ground layers 270 and 272, as shown. Second dielectric layer 266 may include a solid dielectric substrate 274, also referred to simply as a dielectric, having an opening 276 over coupler section $\mathbf{186}_B$ and an opening 278 over coupler section $\mathbf{212}_B$. The openings provide respective air layers 280 and 282, also referred to as a dielectric, over coupler sections $\mathbf{186}_B$ and $\mathbf{212}_B$.

Similarly, third dielectric layer 268 may include a solid dielectric substrate 284 having an Opening 286 under coupler section $\mathbf{186}_B$ and an opening 288 under coupler section $\mathbf{212}_B$. The openings provide respective air layers 290 and 292 under coupler sections $\mathbf{186}_B$ and $\mathbf{212}_B$.

In one example adapted for use in a frequency range of 30 MHz to 512 MHz, dielectric layer 232 may be less than 30 mils thick, such as about 10 mils thick. Layer 232 has opposite faces 232*a* and 232*b* that have a width of about 2.6 inches and a length of about 3.6 inches. Dielectric layers 266 and 268 each may be about 125 mils thick. Other dimensions and configurations may also be used according to the preference of the circuit designer and the application in which the coupler assembly is being used.

The spiral coupler sections $\mathbf{186}_B$ and $\mathbf{212}_B$ may also be formed similar to coupler section 72 described above. For example, the coupler sections may be made with conductors that vary in width and/or have tabs that provide additional capacitance. Further, the conductors may be made so that they couple side-to-side and/or face-to-face. This latter configuration may be achieved by alternating portions of the conductors between faces of the dielectric layer. More specifically conductor 234, forming spiral 238 of coupler section $\mathbf{186}_B$, may include conductor portion 234*a* and corresponding spiral portion 238*a* on dielectric layer face 232*a*, and may include conductor portions 234*b* and 234*c*, and spiral portions 238*b* and 238*c* on dielectric layer face 232*b*. Similarly, conductor 236 and spiral 240 of coupler section $\mathbf{186}_B$ may include conductor portions 236*a* and 236*b* spiral portions 240*a* and 240*b* on dielectric layer face 232*a*. Conductor 236 may also include conductor portion 236*c* and spiral portion 240*c* on dielectric layer face 232*b*.

Conductor 250, forming spiral 254 of coupler section $\mathbf{212}_B$, may include conductor portions 250*a* and 250*b* forming spiral portions 254*a* and 254*b* on dielectric layer face 232*a*. Conductor 250 may also include conductor portions 250*c*, 250*d* and 250*e* forming spiral portions 254*c*, 254*d* and 254*e* on dielectric layer face 232*b*. Similarly, conductor 252, forming spiral 256 of coupler section $\mathbf{186}_B$, may include conductor portions 252*a*, 252*b* and 252*c* forming spiral portions 256*a*, 256*b* and 256*c*, on dielectric layer face 232*a*. Conductor 252 may also include conductor portions 252*d* and 252*e* forming spiral portions 256*d* and 256*e* on dielectric layer face 232*b*. The ends of the various portions of each conductor on the two surfaces of dielectric layer 232 may be connected together through the dielectric layer by interconnects, such as vias 294. All of the conductor and spiral portions on dielectric layer face 232*a* may be part of conductive layer 262, and all of the conductor and spiral portions on dielectric layer face 232 may be part of conductive layer 264.

In the circuit structure shown in FIGS. 11–13, a conductor 296 connects coupler section $\mathbf{186}_B$ with coupler section $\mathbf{212}_B$. Phase inverter $\mathbf{200}_B$ includes a conductor 298 that extends from connection 222 for connection to a capacitance device 226. Other structures for providing a capacitive device may be used, such as a conductive pad on dielectric layer 232 that is coupled to a ground plane. Conductive tabs 300 and 302 extend from ports $\mathbf{202}_B$ and $\mathbf{204}_B$, as shown, to provide compensating capacitance to ground. A conductor 304 connects coupler section $\mathbf{212}_B$ with coupler section $\mathbf{192}_B$. Further, delay line $\mathbf{210}_B$ includes portions $\mathbf{210}_B a$ and $\mathbf{210}_B b$ adapted to be connected to an off-dielectric portion, not shown.

Various operating parameters of a coupler assembly 180, including a circuit assembly 230, over a frequency range of 30 MHz to 512 MHz are illustrated in FIGS. 14–17 for a 10-mil thick dielectric layer 232 and a 125-mil thickness for air layers 102 and 110. Curve 310, shown in FIG. 14 represents the gain on the direct port $\mathbf{202}_B$. It is seen that the gain is generally between −0.5 and about −0.8 over the frequency range. FIG. 15 illustrates a curve 312 that represents the coupling to the coupled port $\mathbf{204}_B$ for a signal input on port $\mathbf{182}_B$. A curve 314 depicts the coupling that would exist for a signal that is input on port $\mathbf{202}_B$ measured on port $\mathbf{184}_B$. The coupling in both examples is about −10 dB, with a ripple of about +0.5 dB to about −1.2 dB.

Curves 316 and 318 shown in FIG. 16 indicate the directivity of coupler assembly 180. Curve 316 represents the isolation between ports $\mathbf{182}_B$ and $\mathbf{184}_B$. Curve 318 represents the isolation between ports $\mathbf{202}_B$ and $\mathbf{204}_B$. Both curves are less than −15 dB over the entire bandwidth. Finally, the voltage standing wave ratio (VSWR) at each port over the bandwidth is shown in FIG. 17. More specifically, the VSWR's for ports $\mathbf{182}_B$, $\mathbf{184}_B$, $\mathbf{202}_B$, and $\mathbf{204}_B$ are represented by respective curves 320, 322, 324, and 326. The VSWR's are generally below 1.2:1 for all but the highest frequencies in the bandwidth.

A coupler assembly, such as coupler assembly 180, may accordingly be designed to function over other frequency ranges, which frequency ranges can be relatively broad. Different combinations and configurations of components, such as coupler sections, phase inverters, and/Or phase shifters may be used as appropriate for different applications.

Accordingly, while inventions defined in the following claims have been particularly shown and described with reference to the foregoing embodiments, those skilled in the art will understand that many variations may be made therein without departing from the spirit and scope of the claims. Other combinations and sub-combinations of features, functions, elements and/or properties may be claimed through amendment of the present claims or presentation of new claims in this or a related application. Such amended or new claims, whether they are directed to different combinations or directed to the same combinations, whether different, broader, narrower or equal in scope to the original claims, are also regarded as included within the subject matter of the present disclosure. The foregoing embodiments are illustrative, and no single feature or element is essential to all possible combinations that may be claimed in this or later applications. Where the claims recite "a" or "a first" element or the equivalent thereof, such claims should be understood to include one or more such elements, neither requiring nor excluding two or more such elements. Further, cardinal indicators, such as first, second or third, for identified elements are used to distinguish between the elements, and do not indicate a required or limited number of such elements, nor does it indicate a particular position or order of such elements.

INDUSTRIAL APPLICABILITY

Radio frequency couplers, coupler elements and components described in the present disclosure are applicable to telecommunications, computers, signal processing and other industries in which couplers are utilized.

The invention claimed is:

1. A circuit assembly comprising:

a first dielectric layer having opposite faces;

a first conductor having first and second ends, and forming at least a first turn, the first conductor including a plurality of portions on alternating faces of the dielectric;

a second conductor also having first and second ends, and forming at least a second turn mutually inductively coupled to the first turn, the second conductor also including a plurality of portions on alternating faces of the dielectric; and a capacitive device coupling the first ends of the first and second conductors to a reference potential, the first and second conductors and the capacitive device being adapted to invert substantially the phase of a signal input on one of the second ends, and to produce the substantially phase-inverted signal on the other of the second ends.

2. A circuit assembly comprising:

at least first and second multi-port coupler sections with the first coupler section being more tightly coupled than the second coupler section;

a phase inverter coupled between a first port of the first coupler section and a first port of the second coupler section, the phase inverter being adapted substantially to invert the phase of a signal input into the phase inverter in a manner also delaying the signal; and a phase shifter coupled between a second port of the first coupler section and a second port of the second coupler section, the phase shifter being adapted to delay a signal input into the phase shifter by an amount corresponding to the delay of the signal in the phase inverter.

3. The circuit assembly of claim 2, in which the first coupler section is substantially a 3 dB coupler.

4. A circuit assembly comprising:

at least first and second multi-part coupler sections;

a phase inverter coupled between a first port of the first coupler section and a first part of the second coupler section, the phase inverter being adapted substantially to invert the phase of a signal input into the phase inverter in a manner also delaying the signal; and a phase shifter coupled between a second part of the first coupler section and a second port of the second coupler section, the phase shifter being adapted to delay a signal input into the phase shifter by an amount corresponding to the delay of the signal in the phase inverter;

at least one of the first and second coupler sections and the phase inverter including a spiral coupler with first and second conductors having mutually inductively coupled turns.

5. The circuit assembly of claim 4, further comprising a dielectric layer having opposite faces, the turns being disposed on the opposite faces.

6. The circuit assembly of claim 5, in which there are an equal number of turns on the opposite faces.

7. The circuit assembly of claim 5, in which each conductor includes a plurality of portions on alternating faces of the dielectric.

8. The circuit assembly of claim 5, in which the first dielectric layer is a solid dielectric and the second and third dielectric layers are air.

9. A circuit assembly comprising:

a dielectric substrate having opposite faces;

a 3 dB first coupler including first and second coupled conductors mounted on the dielectric, the first and second conductors each including a spiral having spiral portions on both sides of the dielectric substrate, the spiral portions of the first conductor being opposite corresponding spiral portions of the second conductor;

a second coupler including second and third coupled conductors coupled more loosely than the first and second conductors;

a delay line coupling the first and third conductors;

a third coupler including fourth and fifth coupled conductors mounted on the dielectric, the fourth and fifth conductors each having opposite ends and including a spiral having spiral portions on both sides of the dielectric substrate, the spiral portions of the fourth conductor being positioned opposite from corresponding spiral portions of the fifth conductor, one end of the fourth conductor being coupled to the second conductor and one end of the fifth conductor being coupled to the fourth conductor, the delay line and third coupler producing corresponding delays; and a capacitor coupling the other ends of the fourth and fifth conductors to a reference potential, the third coupler and the capacitive device being adapted to invert substantially the phase of a signal input on the one end of the fourth conductor, and to produce the substantially phase-inverted signal on the one end of the fifth conductor.

10. A circuit assembly comprising:

an inductive coil having first and second ends, and at least two mutually coupled turns extending between the first and second ends; and a capacitive device coupling an intermediate portion of the inductive coil to a reference potential, the inductive coil and capacitive device adapted to invert substantially the phase of a signal input on the first end, and to produce the substantially phase-inverted signal on the second end.

11. The circuit assembly of claim 10, further comprising a first dielectric layer having opposite faces, the turns being disposed on the opposite faces.

12. The circuit assembly of claim 11, in which there are an equal number of turns on the opposite faces.

13. The circuit assembly of claim 12, in which the turns on the opposite faces are aligned.

14. The circuit assembly of claim 11, in which the inductive coil includes a plurality of portions on each side of the intermediate point on alternating faces of the dielectric.

15. The circuit assembly of claim 11, further comprising second and third dielectric layers, the inductive coil and first dielectric layer being disposed between the second and third dielectric layers, the second and third dielectric layers having a dielectric constant less than a dielectric constant of the first dielectric layer.

16. The circuit assembly of claim 15, in which the first dielectric layer is a solid dielectric and the second and third dielectric layers are air.

17. A circuit assembly comprising:

a first conductor having first and second ends, and forming at least a first turn;

a second conductor also having first and second ends, and forming at least a second turn mutually inductively coupled to the first turn;

a capacitive device coupling the first ends of the first and second conductors to a reference potential, the first and second conductors and the capacitive device being adapted to invert substantially the phase of a signal input on one of the second ends, and to produce the substantially phase-inverted signal on the other of the second ends; and first, second and third dielectric layers, the first dielectric layer having opposite faces on which the turns are disposed, the conductor turns and the first dielectric layer being disposed between the second and third dielectric layers, and the second and third dielectric layers having a dielectric constant less than a dielectric constant of the first dielectric layer.

18. The circuit assembly of claim 17, in which the first dielectric layer is a solid dielectric and the second and third dielectric layers are air.

* * * * *